US009409304B2

(12) United States Patent
Maier et al.

(10) Patent No.: US 9,409,304 B2
(45) Date of Patent: Aug. 9, 2016

(54) CUTTING UNIT FOR A PACKAGING MACHINE

(75) Inventors: Robert Maier, Babenhausen (DE); Elmar Ehrmann, Bad Grönenbach (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 132 days.

(21) Appl. No.: 13/100,730

(22) Filed: May 4, 2011

(65) Prior Publication Data

US 2011/0271812 A1 Nov. 10, 2011

(30) Foreign Application Priority Data

May 6, 2010 (DE) ..... 10 2010 019 634

(51) Int. Cl.

| | |
|---|---|
| ***B26D 1/08*** | (2006.01) |
| ***B26D 5/14*** | (2006.01) |
| ***B65B 61/06*** | (2006.01) |
| *B26D 7/00* | (2006.01) |
| *B65B 9/04* | (2006.01) |

(52) U.S. Cl.

CPC *B26D 1/085* (2013.01); *B26D 5/14* (2013.01); *B65B 61/06* (2013.01); *B26D 7/0006* (2013.01); *B65B 9/04* (2013.01); *Y10T 83/8843* (2015.04); *Y10T 83/929* (2015.04); *Y10T 83/9478* (2015.04)

(58) Field of Classification Search

CPC Y10T 83/8843; Y10T 83/9478; B26D 1/085; B26D 5/14; B26D 5/16; B26D 7/006

USPC ..... 83/561, 562, 642, 643, 644, 646, 697, 83/698.71, 699.11, 635, 626, 557, 686, 83/638, 699.61, 651, 628, 637, 821–829, 83/613, 616, 617, 623, 624, 627, 632; 53/435, 296, 389.3

See application file for complete search history.

(56) References Cited

U.S. PATENT DOCUMENTS

| | | | | | |
|---|---|---|---|---|---|
| 1,569,569 | A | * | 1/1926 | Pels | 83/522.23 |
| 2,128,872 | A | * | 8/1938 | Zahn | 452/141 |
| 2,832,410 | A | * | 4/1958 | Soss | 83/628 |
| 3,182,542 | A | * | 5/1965 | Cochran | 83/453 |
| 3,373,596 | A | * | 3/1968 | Moeller et al. | 72/446 |
| 3,892,155 | A | * | 7/1975 | Gerlach | 83/460 |
| 4,160,409 | A | * | 7/1979 | Portmann | 100/257 |
| 5,848,568 | A | * | 12/1998 | Imanishi | 100/257 |

(Continued)

FOREIGN PATENT DOCUMENTS

| | | | |
|---|---|---|---|
| CN | 1785610 | A | 6/2006 |
| CN | 101323118 | A | 12/2008 |

(Continued)

OTHER PUBLICATIONS

Translation of EP0798254 "Device for selectively slitting, cutting or perforating" Wiechert, Edelbert. Oct. 1997.*

(Continued)

*Primary Examiner* — Laura M Lee

(74) *Attorney, Agent, or Firm* — Husch Blackwell LLP

(57) ABSTRACT

A cutting unit for a packaging machine comprises a cutting knife which is movably guided in a linear guide, and a drive for driving the movement of the cutting knife. The cutting unit further includes a curved push rod that is provided between the drive and the cutting knife.

14 Claims, 2 Drawing Sheets

(56) References Cited

U.S. PATENT DOCUMENTS

| | | | | |
|---|---|---|---|---|
| 6,068,170 | A * | 5/2000 | Yamaguchi et al. | 225/96 |
| 6,109,154 | A * | 8/2000 | Miyatsu et al. | 83/627 |
| 7,950,207 | B2 | 5/2011 | Maisel | |
| 2008/0152767 | A1 | 6/2008 | Maisel | |
| 2010/0293899 | A1 | 11/2010 | Boekstegers et al. | |

FOREIGN PATENT DOCUMENTS

| | | | | |
|---|---|---|---|---|
| DE | 887 489 | C | 8/1953 | |
| DE | 887489 | C | 8/1953 | |
| DE | 2 019 881 | A1 | 11/1971 | |
| DE | 2019881 | A1 | 11/1971 | |
| DE | 30 20 633 | A1 | 12/1981 | |
| DE | 10 2007 013 696 | A1 | 6/2008 | |
| DE | 102007013698 | A1 | 6/2008 | |
| DE | 10 2009 022 545 | B3 | 12/2010 | |
| EP | 0798254 | * | 10/1997 | B26D 5/08 |

OTHER PUBLICATIONS

Chinese Office Action dated Aug. 3, 2012, Applicant Multivac Sepp Haggenmüller GmbH & Co. KG, Application No. 201110117448.8, 12 pages including translation.

German Office Action Dated Dec. 4, 2010, Application No. 10 2010 019 634.7-27. Applicant/Owner: Multivac Sepp Haggenmueller GmbH & Co. KG.

Extended European Search Report Dated Aug. 8, 2011, Application No. 11003695.1-2301, Applicant Multivac Sepp Haggenmueller GmbH & Co. KG.—5 Pages.

European Patent Office Communication & Annex Dated Jan. 24, 2012, Application No. 11 003 695.1-2302, Applicant Multivac Sepp Haggenmueller GmbH & Co KG.

* cited by examiner

CUTTING UNIT FOR A PACKAGING MACHINE

CROSS-REFERENCE TO RELATED APPLICATIONS

This application claims foreign priority benefits under 35 U.S.C. §119(a)-(d) to German patent application number DE 10 2010 019 634.7, filed May 6, 2010, which is incorporated by reference in its entirety.

TECHNICAL FIELD

The present disclosure relates to a cutting unit for a packaging machine.

BACKGROUND

DE 10 2007 013 698 A1 and the post-published DE 10 2009 022 545 A1 disclose thermoformer packaging machines as a special type of packaging machines. In the case of these thermoformer packaging machines, packaging troughs are thermoformed in a bottom foil, filled with a product and subsequently sealed with a cover film. After having been sealed, the packages must be singulated. To this end, cutting units are normally provided in the longitudinal direction and in the transverse direction of the working direction of the packaging machine. These cutting units are subjected to high loads, since they execute fast movements and since they must exert strong forces for cutting through packaging foils, in particular if these packaging foils are thick. Hence, they are liable to fatigue and regular maintenance is necessary. In addition, conventional cutting units often consume a lot of energy and take up much space.

SUMMARY

It is an object of the present disclosure to improve, with the aid of structurally simple means, a cutting unit for a packaging machine such that the above-mentioned drawbacks will be avoided.

In the case of the cutting unit according to the present disclosure, a curved push rod is provided between the drive and the cutting knife. The curved shape of the push rod allows a much better transmission of the forces which are applied by the drive to the push rod and transmitted from the push rod to the cutting knife. Due to the improved transmission of forces, fatigue phenomena of the material will be reduced.

A particularly good distribution of the forces and stresses on the push rod will be accomplished when the push rod has a substantially U-shaped curvature. The ends of the push rod may, however, be bent outwards once more so that—when seen e.g. from one side of the push rod—the resultant whole curvature is a concave-convex-concave curvature.

It will be particularly advantageous when the linear guide is provided with a first lateral guide and a second guide, a transverse member extending between said guides and having the cutting knife secured thereto. Due to the fact that the transverse member is guided on both sides thereof, tilting is prevented and the cutting forces can be transmitted to the packaging films/foils in a defined orientation of the cutting knife. The lateral guides may e.g. be rods or rails.

Preferably, a first end of the push rod is connected to the transverse member via a swivel joint. This allows the push rod to raise the transverse member at different angular positions.

The second end of the push rod can be connected to at least one crank shaft via a swivel joint. This crank shaft will then predetermine the angular positions of the push rod and additionally define the vertical displacement of the push rod.

According to a preferred embodiment, the swivel joint is accommodated in a curved slotted link between the second end of the push rod and the crank shaft. This leads to a substantial increase in the stability of the lifting mechanism and, in addition, to a more smooth and silent running of the cutting knife. Since the movement of the swivel joint is predetermined by the crank shaft, the slotted link does not represent a further forcible control of the swivel joint, but it is primarily provided for reasons of stability.

The slotted link may describe at least a semicircle around an output shaft of the drive or around a gear box shaft of the drive. The swivel joint can thus perform in the slotted link a movement of 180° or more about the shaft. In this way, it can be guaranteed that the cutting movement corresponds to a length up to twice the length of the crank shaft or to a length corresponding precisely to twice the length of the crank shaft.

In order to increase the stability still further, the slotted link may be provided in a plate connected to both lateral guides. It is also imaginable that two plates are provided, which are arranged parallel to one another and each of which is provided with a slotted link.

The crank shaft may be connected to the output shaft of the drive, or it may also be connected to a gear box provided between the drive and the crank shaft.

In one embodiment of the present disclosure, the drive is an electric motor. In contrast to the normally used linear drives or pneumatic drives, this offers the advantage that a reduction of wear will be accomplished and that the use of compressed air can be dispensed with. Instead, the cutting unit (and possibly the whole packaging machine) can be operated with electric energy alone.

A particularly advantageous embodiment is obtained, when the drive is arranged within the installation space delimited by the two lateral guides. In this way, the cutting unit is rendered compact, since the drive no longer projects beyond the sides.

It may also be advantageous, when the longitudinal axis of the drive extends parallel to the cutting knife, when seen from above. In this way, the overall length of the cutting unit will be particularly short in the working direction of the packaging machine, so that a plurality of cutting units or other working units can be arranged in closely spaced succession.

Optionally, the output shaft of the drive may have arranged thereon a gear box, said gear box comprising at least one gear box shaft extending at an angle of 90° relative to the output shaft. In particular, two such gear box shafts may be provided, said gear box shafts extending from the output shaft on both sides. In the latter case, a particularly symmetric distribution of the driving forces will be accomplished.

Finally, the present disclosure also relates to a packaging machine having a cutting unit of the type described hereinbefore.

In the following, an advantageous embodiment of the present disclosure will be explained in more detail on the basis of the below drawings.

DETAILED DESCRIPTION

Figure 1:
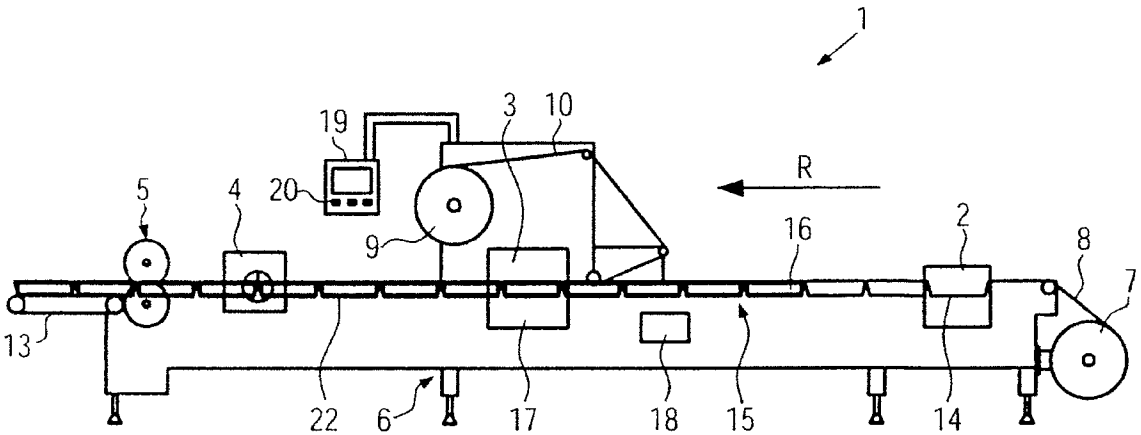
FIG. 1 is a schematic side view of a packaging machine according to the present disclosure in the form of a thermoformer packaging machine.

Identical components are provided with identical reference numerals throughout the figures.

FIG. 1 shows a schematic view of a packaging machine 1 according to the present disclosure in the form of a thermoformer packaging machine. This thermoformer packaging machine 1 comprises a forming station 2, a sealing station 3, a transverse cutting unit 4 and a longitudinal cutting unit 5, which are arranged in this order in a working direction R on a machine frame 6. In the present embodiment, the transverse cutting unit 4 is configured as a cutting unit according to the present disclosure, which will be described in detail hereinbelow.

On the input side, a supply roll 7 is provided on the machine frame 6, from which a first web material 8 is unwound. In the area of the sealing station 3, a material storage unit 9 is provided, from which a second web material 10 used as a cover film is unwound. On the output side, a discharge device 13 in the form of a transport conveyor is provided at the packaging machine, with which finished, singulated packages are transported away. Furthermore, the packaging machine 1 comprises a feeding device which is not shown, said feeding device gripping the first web material 8 and transporting it cyclically in a main work cycle in the working direction R. The feeding device can be realized, for example, by laterally arranged transport chains.

In the embodiment shown, the forming station 2 is realized as a thermoforming station in which containers 14 are formed in the first web material 8 by thermoforming. The forming station 2 can be configured such that in the direction perpendicular to the working direction R several containers are formed side by side. In the working direction R behind the forming station 2, a filling area 15 is provided, in which the containers 14 formed in the first web material 8 are filled with the product 16.

The sealing station 3 is provided with a closable chamber 17 in which the atmosphere in the containers 14 can be substituted, prior to sealing, by an exchange gas or by an exchange gas mixture, e.g. by gas flushing.

The transverse cutting unit 4 is configured as a punch separating the first web material 8 and the second web material 10 in a direction transversely to the working direction R between neighbouring containers 14. In so doing, the transverse cutting unit 4 works such that the first web material 8 is not cut across the whole width of the web, but remains uncut in at least an edge area. This allows controlled further transport by the feeding device.

In the embodiment shown, the longitudinal cutting unit 5 is configured as a blade arrangement by means of which the first web material 8 and the second web material 10 are cut between neighbouring containers 14 and at the lateral edge of the first web material 8, so that, downstream of the longitudinal cutting unit 5, singulated packages are obtained.

The packaging machine 1 is additionally provided with a controller 18. It is used for controlling and monitoring the processes taking place in the packaging machine 1. A display device 19 with operating controls 20 serves to make the sequences of process steps in the packaging machine 1 visible to an operator and to influence them by the operator.

The general mode of operation of the packaging machine 1 will be described briefly in the following.

The first web material 8 is unwound from the supply roll 7 and conveyed into the forming station 2 by the feeding device. In the forming station 2, containers 14 are formed in the first web material 8 by thermoforming. Together with the material of the first web material 8 surrounding them, the containers 14 are advanced, in a main work cycle, to the filling area 15 where they are filled with the product 16.

Subsequently, the filled containers 14 are, together with the material of the first web material 8 surrounding them, advanced by the feeding device into the sealing station 3 during the main work cycle. After having been sealed onto the first web material 8, the second web material 10 is advanced as a cover film when the feed motion of the first web material 8 takes place. In the course of this process, the second web material 10 is unwound from the material storage unit 9. By sealing the cover film 10 onto the containers 14, closed packages 21 are obtained.

In the cutting units 4, 5 the packages 21 are singulated by cutting through the web materials 8, 10 in the transverse direction and in the longitudinal direction. The transverse cutting unit 4 is an example of a cutting unit according to the present disclosure.

Figure 2:
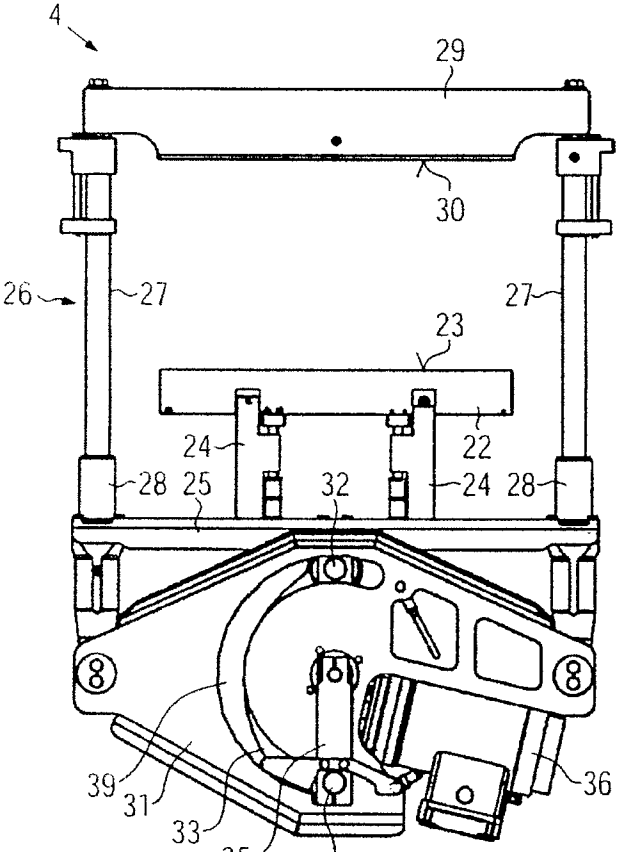
FIG. 2 is a view of the cutting unit at a position in which the cutting knife has been lowered.

FIG. 2 shows a view of a transverse cutting unit 4 in the direction of the conveying direction R of the packaging machine 1. The cutting unit 4 is provided with a cutting knife 22 having a cutting edge 23 on the upper side thereof. The cutting knife 22 is mounted on a transverse member 25 via two fastening elements 24. The cutting knife 22 may in particular be releasably fastened to the fastening elements 24 so that a damaged or worn-out cutting knife 22 can be replaced.

The cutting knife 22 is guided in a vertical linear guide 26 for carrying out a vertical movement. This linear guide comprises the transverse member 25, two vertically oriented lateral guides 27 configured as rods as well as two sleeves 28, each of them provided on one end of the transverse member 25 and enclosing a respective lateral guide 27. Since the sleeves 28 are higher than the transverse member 25 in the axial direction of the lateral guides 27, they prevent tilting of the transverse member 25, and guarantee thus a more smooth and silent running of the cutting knife 22 as well as a defined, horizontal orientation of the cutting edge 23.

The two lateral guides 27 are, at the upper end thereof, interconnected by an (optionally slotted) counter pressure bar or a counter knife 29 having, at the lower end thereof, a horizontal (cutting) edge 30 cooperating with the cutting edge 23 of the cutting knife 22. The lower ends of the two lateral guides 27 are interconnected by two vertically oriented support plates 31, which are arranged parallel to one another. The support plates 31 substantially have the shape of a parallelogram.

Figure 3:
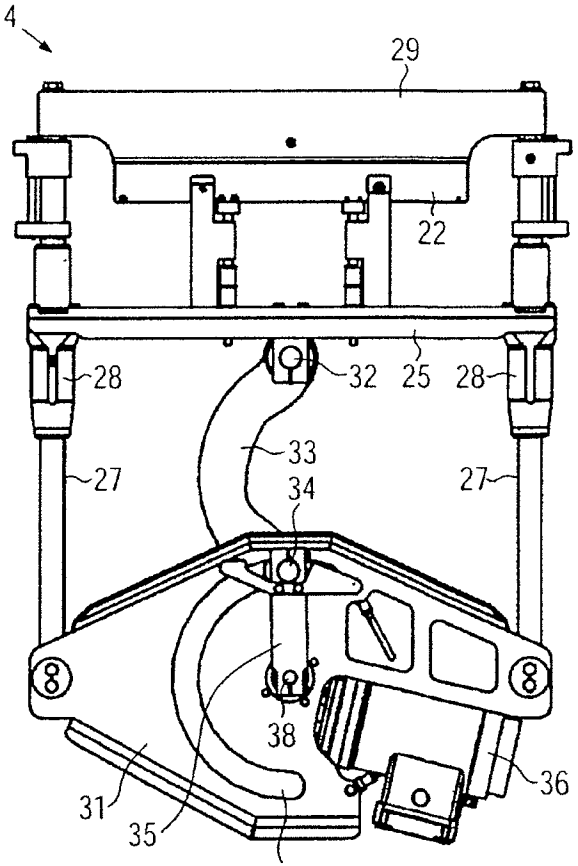
FIG. 3 is a view of the cutting unit according to the present disclosure at a position in which the cutting knife has been raised.

As can especially be seen from FIG. 3, a projection on the transverse member 25 is connected to a curved push rod 33 via a first swivel joint 32. The push rod has a substantially U-shaped curvature. The ends, however, are bent outwards once more relative to the U-shaped curvature. Seen from the left side in FIG. 3, a concave-convex-concave curvature of the whole push rod thus results. Seen from the right side in FIG. 3, a convex-concave-convex curvature of the push rod 33 results.

A second, lower end of the push rod 33 is connected to the crank shaft 35 via a second swivel joint 34. Actually, a respective crank shaft 35 can be provided on either end of the second swivel joint 34.

The support plates 31 have secured thereto a drive 36 for driving the movement of the cutting knife 22. In the present embodiment, the drive 36 is an electric motor. This electric motor 36 is provided with an output shaft which is directed in the axial direction of the drive 36. The output shaft (not shown) ends at a gear box 37. The gear box comprises two gear box shafts 38 extending respectively from the output shaft of the drive 36 at an angle of 90° to the right and to the left. The gear box shafts 38 are operated by means of the output shaft. The gear box shafts 38 may also be implemented as hollow shafts through which an axle is passed.

Each of the two horizontally oriented gear box shafts 38 is connected to a crank shaft 35. A rotation of the gear box shafts 38 results in a rotation of the crank shafts 35 about the gear box 37.

When seen in the conveying direction R, i.e. in the view according to FIGS. 2 and 3, the drive 36 is located fully within the installation space which is delimited at the right and at the left by the two lateral guides 27. The output shaft of the drive 36 is located between the two support plates 31. When seen from the side, also the push rod 33 is located between the two support plates 31, whereas the crank shafts 35 are arranged on the outer sides of the two support plates 31. The gear box shafts 38 as well as the second swivel joint 34 extend through the two support plates 31.

A semicircular slotted link 39 is provided in the support plates 31. The slotted link 39 extends over an angle of 180° around the gear box shafts 38 of the gear box 37.

In the following, the operation of the cutting unit 4, 5 according to the present invention will be explained.

In FIG. 2 the cutting unit 4, 5 occupies a position in which the cutting knife 22 has been lowered. The distance between the cutting edge 23 of the cutting knife 22 and the cutting edge 30 of the counter knife 29 is large enough for allowing filled and sealed packages 21 to be conveyed between the two cutting edges 23, 30 and between the two lateral guides 27.

As soon as the advance movement of the packages 21 has been stopped, the cutting knife 22 is moved to the raised position (or cutting position) shown in FIG. 3. To this end, the output shaft of the drive 36 moves the gear box shafts 38 such that they rotate about their respective axes. This rotation has the effect that the crank shafts 35 connected to the gear box shafts 38 are pivoted about the gear box shafts 38. In the course of this process, the second swivel joint 34, which extends through the support plates, moves from the lower end of the slotted link 39 through the whole slotted link 39 up to the upper end thereof. In FIG. 3, the swivel joint 34 has reached this position at the end of the slotted link 39. The crank shaft 35 moves here from a downwardly directed position to an upwardly directed position, starting from the gear box shaft 38 in each case. The stroke of the cutting knife 22 thus corresponds to twice the distance between the axis of the gear box shaft 38 and the axis of the second swivel joint 34.

The second swivel joint 34 has the push rod 33 connected thereto. Due to the forcible control exerted by the linear guide 26, the transverse member 25 and the cutting knife 22 move vertically upwards, when the lower swivel joint 34 and, together therewith, the push rod 33 are raised. The sleeves 28 guarantee that the horizontal orientation of the transverse member 25 and of the cutting knife 22 is always maintained. The angle of the push rod 33 adjusts itself in a suitable manner between the two swivel joints 32, 34.

The transverse member 25 is raised until the cutting edges 23, 30 of the cutting knife 22 and of the counter knife 29 strike against one another, whereby the films/foils of the packages 24 between the two cutting edges 23, 30 are cut through.

In FIGS. 2 and 3 it can be seen that the cutting edges 23, 30 do not extend over the whole distance between the two lateral guides 27. Hence, an area of the packaging films/foils 8, 10, which is used for further conveying the packages 21, can remain uncut laterally next to the two cutting edges 23, 30. It is also possible that a chain guide used for conveying the packaging films/foils 8, 10 extends in the area next to the two cutting edges 23, 30.

Figure 4:
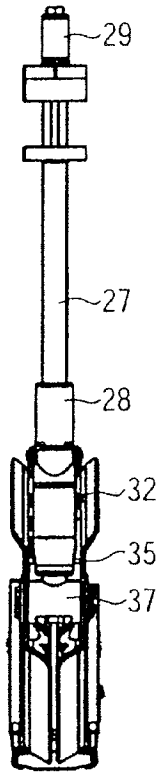
FIG. 4 is a side view of the cutting unit according to the present disclosure.

The cutting unit shown in FIGS. 2 to 4 may also be used as a longitudinal cutting unit 5, instead of as a transverse cutting unit 4, in the packaging machine 1. For example, the entire device shown in FIG. 2 may be oriented so that the cutting knife 22 extends in the longitudinal direction or conveying direction R, and the lateral guides 27 may be offset with respect to the cutting knife 22 in the transverse direction so that the lateral guides 27 do not obstruct the transport of the packaging films/foils 8, 10.

As another example, the cutting knife 22 shown in FIG. 2 may be oriented in the longitudinal direction (i.e., rotated 90 degrees with respect to the transverse member 25 shown in FIG. 2), and the cutting knife 22 may be connected to the transverse member 25 with a single fastening element that extends in the longitudinal direction in order to provide support to the cutting knife 22 in the longitudinal direction. With this configuration, the lateral guides 27 would remain disposed on opposite sides of the films/foils 8, 10. One or more additional cutting knives oriented in a similar manner may also be attached to the transverse member 25 so that the cutting unit 5 may be used to cut multiple longitudinal cuts in the films/foils 8, 10.

As yet another example, a cutting unit 5 may be provided with four lateral guides 27, such that two lateral guides 27 are disposed on each side of the films/foils 8, 10; two transverse members 25 that are spaced apart from each other in the longitudinal direction and that each extend between two lateral guides 27 disposed on opposite sides of the films/foils 8, 10; and one or more cutting knives 22 that extend in the longitudinal direction between the transverse members 25 and that are fastened to the transverse members 25 with fastening elements 24, for example. Such a cutting unit 5 may also be provided with a single push rod and drive assembly that is connected to both transverse members 25, such as via a longitudinal member that extends between the transverse members 25. As an alternative, the cutting unit 5 may be provided with two push rod and drive assemblies, each of which is connected to a respective transverse member 25.

With any of the above embodiments, the upper pressure bar or counter knife 29 with its blade or edge 30 should, of course, always be adapted to reflect the configuration and orientation of the lower cutting knife 22 and its cutting edge 23. Likewise, if a particular cutting unit 5 is provided with multiple cutting knives, then the cutting unit 5 may also include multiple counter knives oriented in the longitudinal direction, such that each cutting knife is aligned with a respective counter knife.

Starting from the embodiment shown, the cutting unit 4, 5 according to the present disclosure may also be modified in other respects. For example, the lateral guides 27 need not be implemented as rods, but one or both lateral guides may also be implemented as rail/rails. Instead of the sleeves 28, an adequate sliding member may be used, said sliding member being connected to the transverse member 25. Instead of two support plates 31, it is also possible to provide only one support plate 31. Instead of two crank shafts 35, only a single crank shaft 35 may be provided in a different embodiment. It is also imaginable to connect the lower end of the crank shaft 35 not to a gear box shaft 38, but directly to the output shaft of the drive 36. The longitudinal axis of the drive 36, i.e. the axis of the output shaft of the drive 36, may extend horizontally or—as shown in FIGS. 2 and 3—at an angle to the horizontal.

Deviating from the embodiment shown, the drive 36 may also be implemented as an electric motor with a disc-shaped rotor in the case of which a cylindrical hollow axis is driven. This hollow axis of the electric motor 36 with a disc-shaped rotor may be coupled directly to the push rod 33 so that the crank shaft 35 can be dispensed with in this embodiment.

The gear box is preferably very stable in the case of the cutting unit 4 according to the present disclosure. By supporting the gear box casing on the support plates 31 and by connecting the crank shafts 35 directly to the gear box shafts 38, the gear box 37 can be provided with a stability that is so high that no additional bearing parts or bearing points are necessary for absorbing, when the transverse cutting unit 4 is in operation, the process forces occurring due to the cutting process and due to the weight of the crank shafts 35 and of the push rod 33. In order to increase the stability of the gear box 37 still further, the gear box can be supported in special (e.g. hardened) bearings having a higher load bearing capacity.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A cutting unit for a packaging machine, the cutting unit comprising:

a movable cutting knife, said cutting knife disposed on a transverse member;

a linear guide associated with the cutting knife, said transverse member being in operable engagement with said linear guide for guiding the cutting knife and the transverse member in a linear manner, wherein the linear guide comprises a first lateral guide, a second lateral guide, and said transverse member extending between the lateral guides;

a drive for driving the movement of the cutting knife; and a U-shaped push rod disposed between and pivotally coupled to the drive and the transverse member, the push rod being curved substantially along its entire length;

at least one crank shaft coupled to the drive;

a first end of the push rod pivotally coupled to the transverse member at a first swivel joint and a second end of the push rod pivotally coupled to the at least one crank shaft at a second swivel joint; and wherein the drive has an output shaft drivingly engaged with the at least one crank shaft.

2. A cutting unit according to claim 1 further comprising a curved slot for guiding a movement of said second swivel joint, wherein the second swivel joint moves within the slot.

3. A cutting unit according to claim 2 wherein the drive has an output shaft, and the slot defines at least a semicircular path around the output shaft.

4. A cutting unit according to claim 2 wherein the drive includes a gear box having a shaft, and the slot defines at least a semicircular path around the gear box shaft.

5. A cutting unit according to claim 2 further comprising a plate extending between and connected to the first and second lateral guides, wherein the slot is provided in the plate.

6. A cutting unit according to claim 1 wherein the drive comprises an electric motor.

7. A cutting unit according to claim 1 wherein the drive is arranged within an installation space delimited by the first and second lateral guides.

8. A cutting unit according to claim 1 wherein the drive has an output shaft and a gearbox provided on the output shaft, and the gear box comprises at least one gear box shaft extending at an angle of 90° relative to the output shaft.

9. A cutting unit according to claim 8 wherein the drive has a longitudinal axis that extends parallel to the cutting knife when viewed from above.

10. A cutting unit according to claim 1 wherein the push rod has a concave-convex-concave curvature.

11. A cutting unit for a packaging machine, the cutting unit comprising:

a movable cutting knife;

first and second lateral guides;

a transverse member extending between the first and second lateral guides and the cutting knife being disposed on said transverse member, said transverse member being in operable engagement with said first and second lateral guides for guiding the cutting knife and the transverse member in a linear manner;

a drive for driving the movement of the cutting knife;

a crank shaft having first and second ends, the second end of the crank shaft being operably connected to the drive; and a U-shaped push rod having first and second ends defining a length and said push rod is curved substantially along the length, wherein the first end of the push rod is pivotally coupled to the transverse member at a first swivel joint and the second end of the push rod is pivotally coupled to the first end of the crank shaft at a second swivel joint;

wherein a linear movement of said cutting knife results from a rotation of said crank shaft, wherein said crank shaft rotates about an axis of rotation, and wherein a line normal to said axis of rotation and passing through said first swivel joint is substantially parallel to a direction of the linear movement of said cutting knife.

12. The cutting unit according to claim 11 further comprising an arcuate guide slot, said second swivel joint operably engaged with said guide slot, wherein said crank shaft is rotatable about an axis of rotation, and wherein said guide slot guides a movement of said second swivel joint around said axis of rotation upon a rotation of said crank shaft.

13. A cutting unit for a packaging machine, the cutting unit comprising:

a movable cutting knife;

first and second lateral guides;

a transverse member extending between the first and second lateral guides and the cutting knife being disposed on said transverse member, said transverse member being in operable engagement with said first and second lateral guides for guiding the cutting knife and the transverse member in a linear manner;

a drive for driving the movement of the cutting knife;

a crank shaft having first and second ends, the second end of the crank shaft being operably connected to the drive; and a U-shaped push rod having first and second ends defining a length and said push rod is curved substantially along the length, wherein the first end of the push rod is pivotally coupled to the transverse member at a first swivel joint and the second end of the push rod is pivotally coupled to the first end of the crank shaft at a second swivel joint;

wherein the cutting knife moves in a linear manner from a lowered position to a raised position upon a rotation of said crankshaft about an axis of rotation, wherein when said cutting knife is in said lowered position, said first swivel joint, said second swivel joint and said axis of rotation are in vertical alignment.

14. The cutting unit according to claim 13 wherein when said cutting knife is in said raised position, said first swivel joint, said second swivel joint and said axis of rotation are in vertical alignment.

* * * * *